United States Patent [19]

Hermanson

[11] 4,193,415

[45] Mar. 18, 1980

[54] UMBRELLA CANOPY FRAME AND STAFF CONSTRUCTION

[76] Inventor: Terry Hermanson, c/o Mr. Christmas Incorporated, 41 Madison Ave., New York, N.Y. 10010

[21] Appl. No.: 2,060

[22] Filed: Jan. 9, 1979

[51] Int. Cl.[2] ..... A45B 19/00

[52] U.S. Cl. ..... 135/25 R

[58] Field of Search ..... 135/20 R, 25 R

[56] References Cited

U.S. PATENT DOCUMENTS

| | | | |
|---|---|---|---|
| 341,192 | 5/1886 | Webster | 135/25 R |
| 1,699,717 | 1/1929 | Rinne | 135/25 R |
| 1,890,440 | 12/1932 | Monz et al. | 135/25 R |
| 2,143,978 | 1/1939 | Eeles | 135/25 R |
| 2,264,881 | 12/1941 | Herbin | 135/25 R |

*Primary Examiner*—J. Karl Bell

*Attorney, Agent, or Firm*—Karl W. Flocks

[57] ABSTRACT

Umbrella construction comprising first and second hub members in combination with a canopy frame member and a staff member, the hub members being spaced-apart from each other on opposite sides of the staff member, independent of each other, and provided with a plurality of holes, the staff member including two series of links forming a lazy-tong device adapted to fold together into closed condition and to unfold into opened condition, the two series of links each having an upper link unit pivotally connected to the upper link unit of the other at the upper ends thereof when the staff means is in opened condition, one of the hub members being secured to the upper link unit of one of the series of links adjacent the upper end thereof, the other of the hub members being secured to the upper link unit of the other of the series of links adjacent the upper end thereof and on a side of the staff member opposite from the one of the hub members. The canopy frame member includes a circumferentially extending series of pairs of ribs, each rib of the pairs being pivotally connected to the other at a point intermediate the opposite ends thereof. A plurality of spokes each have a radially inner end extending in a separate one of the holes of the hub members and a radially outer end pivotally secured to a separate pair of the ribs at the intermediate point thereof.

12 Claims, 7 Drawing Figures

FIG. 4.
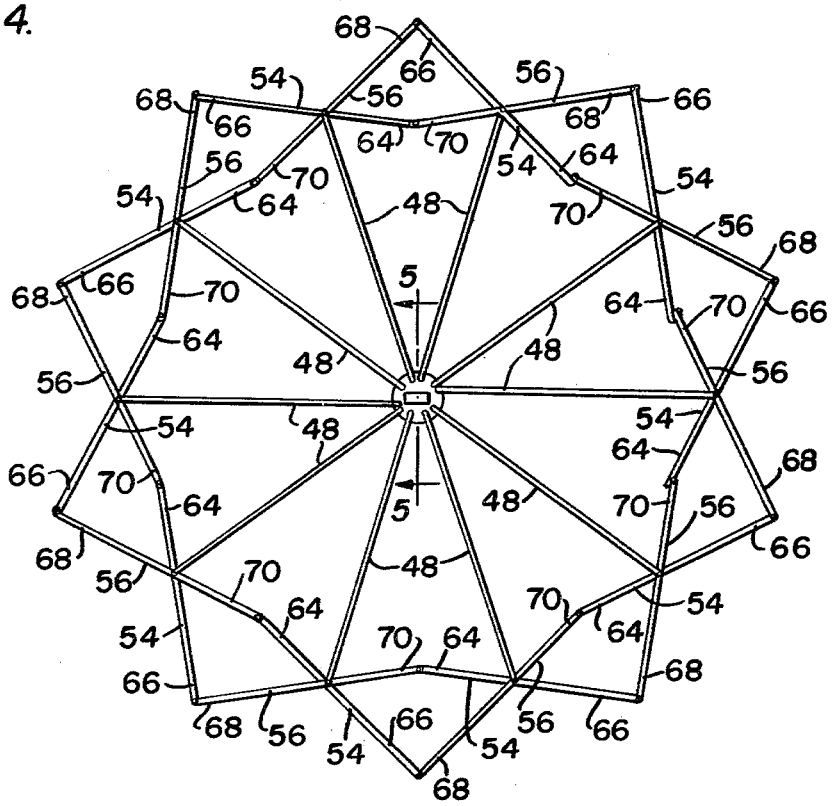
FIG. 5.
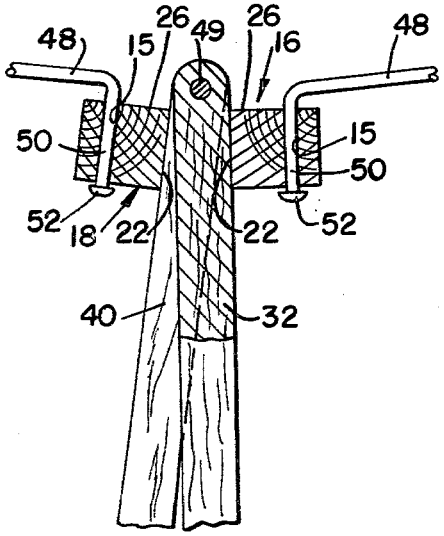
FIG. 6.
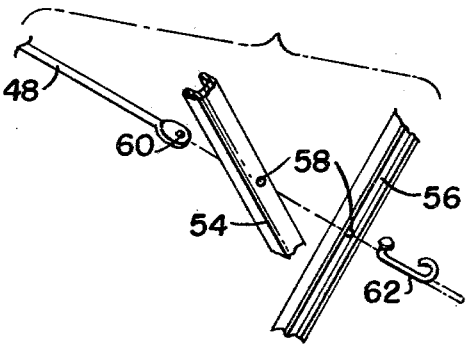
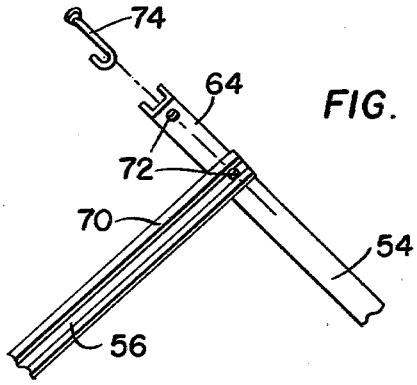
FIG. 7.

UMBRELLA CANOPY FRAME AND STAFF CONSTRUCTION

BACKGROUND OF THE INVENTION

This invention relates to a new and improved umbrella canopy frame and staff member in combination therewith. In particular this invention relates to a new and improved canopy frame in combination with a staff member which is collapsible from the opened condition of the umbrella into a neat and compact storage or carrying condition when the umbrella is closed.

The umbrella art is highly developed so that revolutionary advances therein may not be expected. Applicant nevertheless has developed a new and improved combination of elements wherein an umbrella is provided with a canopy frame and handle member of the lazy-tong construction wherein the canopy frame is opened simultaneously with extension of the staff and is closed simultaneously with the staff when the latter is collapsed.

PRIOR ART

To applicant's knowledge the most relevant prior are includes the following U.S. Pat. Nos. 341,102—WEBSTER; 1,699,717—RINNE; 1,836,322—HAAKER; 1,890,440—MONZ et al.

Of the art listed above, Webster and Haaker U.S. Pat. Nos. 341,192 and 1,836,322, respectively, are of interest in that they disclose umbrella frames comprising lazy-tong linkage members. The linkage systems of Webster and Haaker each include links extending to a sleeve element fixed to a pole and to a sleeve extending around the pole in sliding relationship toward and away from the fixed sleeve.

Rinne and Monz et al U.S. Pat. Nos. 1,699,717 and 1,890,440, respectively, are of relevance in that they relate to umbrella arrangements including lazy-tong linkages in the respective handles thereof. The Rinne umbrella also includes lazy-tong linkages in the canopy support frame with inner radial ends of some of the linkages secured to a fixed sleeve hub and inner radial ends of other linkages secured to a sleeve hub which may be slid toward and away from the fixed hub to effect opening and closing. The Monz et al umbrella also comprised a lazy-tong linkage system for the canopy support rib arrangement. In Monz et al., the radially inner ends of some of the ribs are connected to one disc while inner ends of other ribs are connected to a second disc which appears to be coaxial to the first disc but rotatable relative thereto.

Although the above patents individually show some of features which appear to be similar to features disclosed in the invention disclosed herein, none appears to show the structural combination of features whereby the canopy frame will be opened or closed simultaneously with the extension or collapse of the handle as disclosed herein.

OBJECTS OF THE INVENTION

It is an object of this invention to provide a new and improved umbrella in which the staff is extendible or collapsible as dictated by weather conditions as to whether the umbrella is to be put to use or to be put and/or held in storage condition.

More importantly, it is an object of this invention to provide a new and improved combination of structural elements in an umbrella whereby its canopy frame will be opened simultaneously and automatically by extending the collapsed or folded handle and will be closed simultaneously and automatically by collapsing or folding the handle all in the same motion.

BRIEF DESCRIPTION OF THE DRAWINGS

FIG. 4 is a top plan view of the opened canopy frame of FIG. 2;

FIG. 5 is a sectional view on an enlarged scale taken along the plane 5—5 and looking in the direction of the arrows in FIG. 4;

FIG. 6 is an exploded fragmentary view in perspective and on an enlarged scale showing a pin and a pair of ribs and a spoke to be pivotally connected thereby; and FIG. 7 is an exploded fragmentary view in perspective and on an enlarged scale showing adjacent ends of one rib of each of two series of pairs ribs and pin for pivotally connecting such ends.

DETAILED DESCRIPTION OF THE INVENTION

Figure 1:
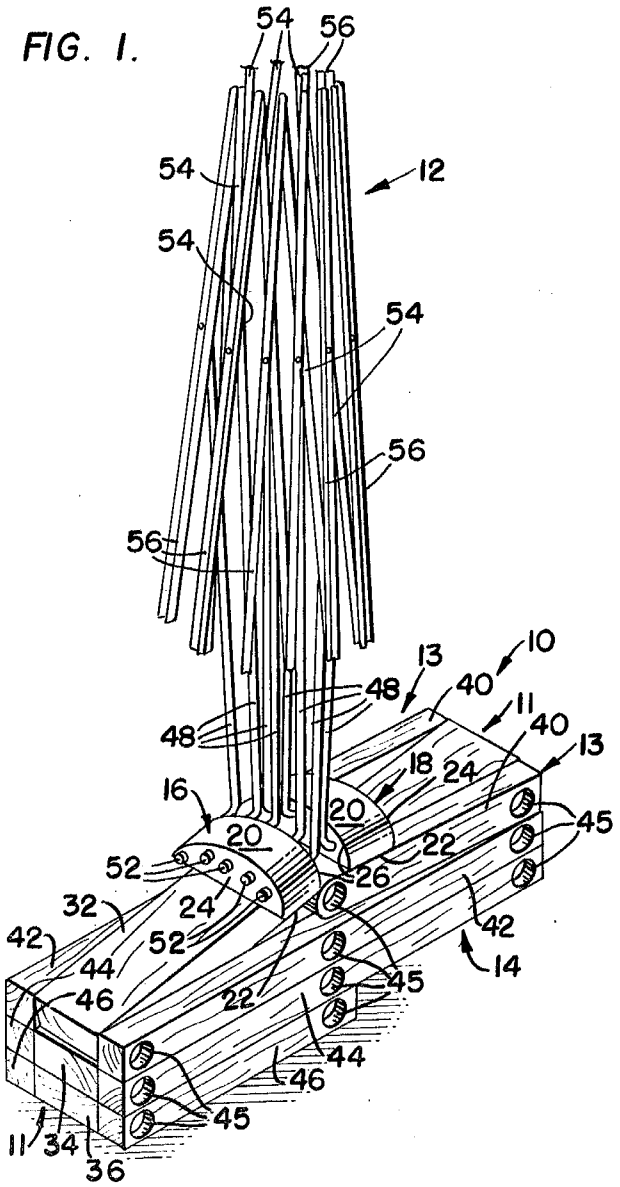
FIG. 1 is a view in perspective showing the umbrella canopy frame and staff members according to the invention disclosed herein in closed condition and supported in upright position.
Figure 2:
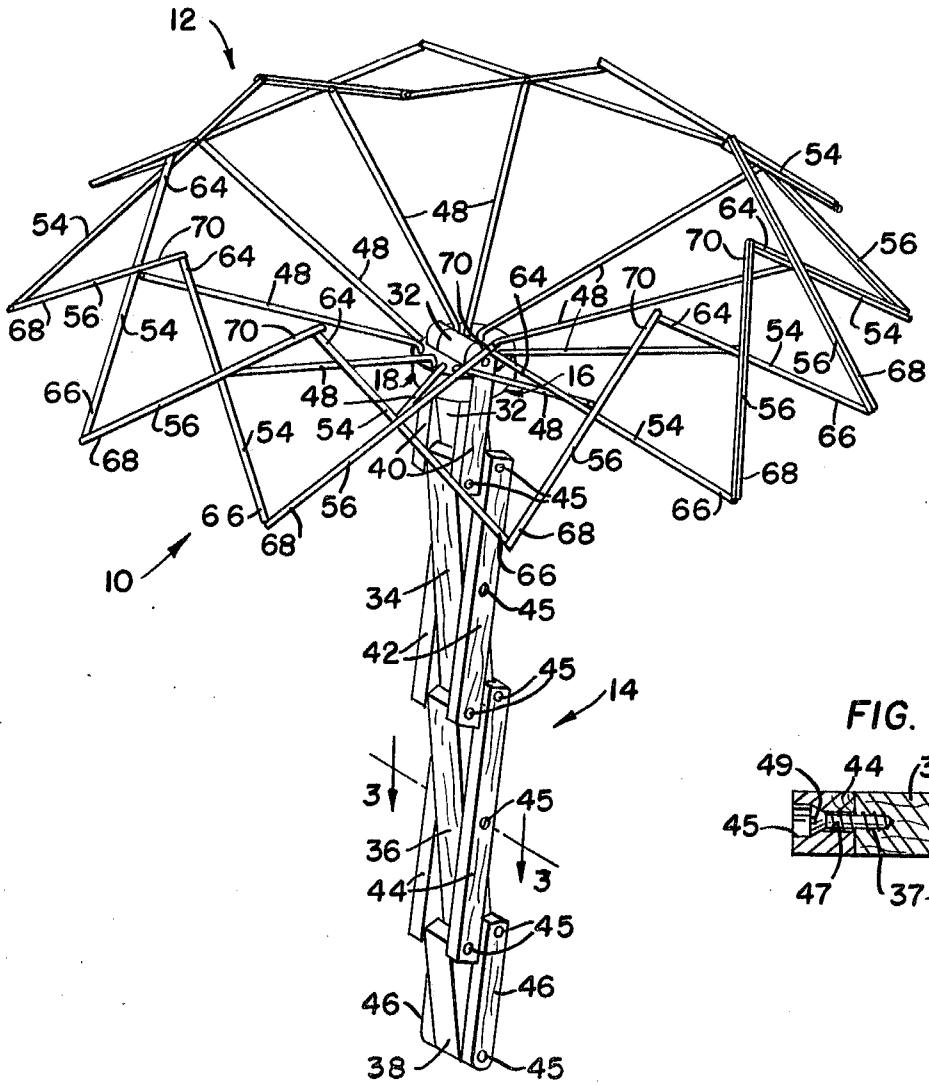
FIG. 2 is a view in perspective of the umbrella canopy frame and staff member of FIG. 1 in opened condition.
Figure 3:
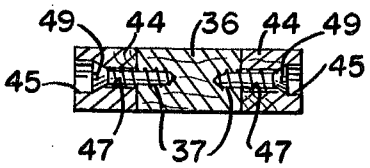
FIG. 3 is a sectional view taken along the plane 3—3 and looking in the direction of the arrows in FIG. 2.

Referring now in detail to the drawings the reader will readily appreciate from FIGS. 1 and 2 that the present invention relates to a new and improved umbrella construction 10 comprising a canopy frame 12 and a staff member 14 which are operatively connected to each other by a pair of hub members 16, 18. As may be readily seen in FIG. 1 each of the hub members 16, 18 is in the form of a semicircular disc with an arcuate portion 20, a diametral edge 22, and a pair of generally parallel sides 24, 26. In the closed condition of the umbrella construction 10 illustrated in upright condition in FIG. 1 the sides 26 of hub members 16, 18 extend in side-by-side relationship to each other. In the opened condition of the umbrella construction 10 the diametral edges 22 of hub members 16, 18 extend in confronting relationship to each other and are separated from each other by upper link units 28, 30 of staff member 14 as may be readily seen in FIGS. 2, 4, and 5.

Staff member 14 comprises two series 11, 13 of links forming a lazy-tong structure, which can be readily seen in FIG. 2 in the extended condition of staff member 14. One series 11 of links comprises link units 32, 34, 36, 38 while the other series 13 of links comprises link units 40, 42, 44, 46. Link units 32, 34, 36, 38 are each formed at about half as wide as the length of diametral edge 22 of hub member 16 while link units 40, 42, 44, 46 are each formed at about a fourth as wide as the length of diametral edge 22 of hub member 18. Hub member 16 is fixedly secured to upper link unit 32 of series 11 adjacent the upper end thereof with the width of upper link unit being centered along the length of diametral edge 22 of hub member 16. To provide a stable lazy-tong construction the series 13 of links is formed as series of pairs of link units 40, 42, 44, 46 each pair of which are disposed on opposite sides of link units 32, 34, 36, 38, respectively, in straddled relationship therearound. Hub member 18 is fixedly secured to upper link units 40 of series 13 adjacent the upper end thereof outwardly of opposite sides link unit 32. In the closed condition of canopy frame 12, the link units 40, 42, 44, 46 are folded against each as illustrated in FIG. 1 in a stack while link units 32, 34, 36, 38 are also folded against each other and diagonally successively from end to end of link units 40, 42, 44, 46. Upper link units 32 and 40 and lower link units 38 and 46 are about half as long as intermediate link units 34, 36, 42 and 44 as clearly shown in FIG. 2. Upper link units 32 and 40 are pivotally connected to each other at the upper ends thereof and lower link units 38 and 46 are pivotally connected to each other at the lower ends thereof. The lower end of upper link unit 32 is pivotally connected to link units 42 at the upper end thereof. Link units 42 in addition to being connected to upper link unit 32 are also pivotally connected at the lower end thereof to the upper end of link unit 36 and to link unit 34. The connection between link units 42 and 34 is at an intermediate portions of these link units 42 and 34. Starting at the lower end of link unit 32 which is pivotally connected to the upper end of link units 42, it is seen that from end to end link units 32, 42, 36 and 46 are successively pivotally connected to each other. Similarly, starting at the lower end of link unit 40 which is pivotally connected to the upper end of link unit 34, from end to end link units 40, 34, 44 and 38 are successively pivotally connected to each other. Link units 44 and 36 are also pivotally connected to each other at respective intermediate portions thereof. The two series 11, 13 as described are thus seen to form a lazy-tong structure which is selectively folded to a compact storage and/or idle carrying condition as illustrated in FIG. 1 or unfolded into an extended staff 14 for an umbrella as illustrated in FIG. 2.

Each of the hub members 16, 18 is provided with a plurality holes, designated 15 in FIG. 5, in the respective side 26 extending in confronting relationship to each other in FIG. 1 and in substantially coplanar relationship in FIG. 2. Extending radially from each hole 15 is a spoke 48. Each spoke 48 has finger-like member 50 bent at about 90° from the main portion thereof at the radially inner end. The finger-like members 50 each extend into one of the holes 15 in hub members 16, 18 and may, for example, be secured thereto by an enlarged or headed end 52. In the opened condition of umbrella construction 10 spoke 50 extend radially outwardly from hub members 16 or 18, are spaced circumferentially from each other, constitute the support for canopy frame 12.

The canopy frame 12 as best seen in FIGS. 2 and 4 comprise a circumferential series of pairs of ribs 54, 56 on which a canopy may be attached. Each pair of ribs 54, 56 as in FIG. 6 is provided with a perforation 58 intermediate opposite ends thereof, while the radially outer end of a spoke 48 is provided with a perforation 60. In the assembled condition of ribs 54, 56 and spoke 48 a pin 62 is received in perforations 58, 60 to pivotally secure the radially outer end of a spoke and an intermediate portion of each of a pair of ribs 54, 56 together. From the foregoing it is seen that each of the ribs 54, 56 in a pair is pivotally assembled in X relationship to the other. Considered in a clockwise direction it is seen that each rib 54 extends upwardly to a leading end 64 from a trailing end 66 and each rib 56 extends downwardly to a leading end 68 from a trailing end 70. It is further seen that the leading end 64 of rib 54 in each pair of ribs 54, 56 in the series is connected to the trailing end 70 of the rib 56 of the pair of ribs 54, 56 immediately in front thereof and the trailing end 66 of rib 54 in each pair of ribs 54, 56 in the series is connected to the leading end 70 of the rib 56 of the pair of ribs 54, 56 immediately therebehind. As may be readily seen in FIG. 7 the leading end 64 of a rib 54 of one pair of ribs 54, 56 is provided with a perforation 72 which in assembly will be brought in alignment with a perforation 72 of the trailing end 70 of the rib 56 immediately thereahead for reception of pin 74 which will pivotally connect the illustrated ribs 54, 56.

Details of the pivotal connection between link unit 36 and each of the link units 44. In this regard it is noted that link unit includes a bore 37 extending laterally therein from each side thereof and each of the link units 44 includes a bore 45 extending laterally therethrough and which in assembly are in line with one of the bores 37 of link unit 36. Each of the bores 45 includes a reduced diameter portion 47 through which the threaded portion of a screw 49 extends to secure link units 36 and 44 together. Although portion 47 is of reduced diameter compared to the outer portion of bore 45 in which the head of screw 49 is seated in assembly, portion 47 is slightly larger than bore 37 so as to facilitate articulation between link unit 36 and link units 44. From the foregoing it is to be understood that the threaded element of screw 59 bites into the wall of bores 37 to effect assembly of the various parts, but will loosely in reduced portion 47 of bore 45 to facilitate articulation between link unit 36 and link units 44 when it is desired to either fold or unfold staff member 14. A similar pivotal connection between the various link units is to be understood to be provided at locations with bores 45 illustrated in FIGS. 1 and 2.

In view of the above description and drawings, the reader should readily be in a position to appreciate that the umbrella construction 10 according to the disclosed invention comprises first and second hub members 16, 18 in combination with a canopy frame 12, and a staff member 14 wherein the hub members 16, 18 are spaced-apart from each other on opposite sides of staff member 14, independent of each and provided with a plurality of holes 15. The reader should also readily appreciate that the staff member 14 includes two series, namely an inner series 11 and an outer series 13 forming a lazy-tong device adapted to fold together into closed condition and to unfold into opened condition. The two series 11, 13 of links each has at least one upper link unit 32, 40 pivotally connected to the upper link 40, 32, respectively, of the other series 13, 11 at the upper ends thereof when the staff member 14 is in opened condition. The hub members 16, 18 are secured to upper links units 32, 40, respectively, adjacent the upper ends thereof on opposite sides of the staff member 14. The canopy frame 12 can be readily seen to include a circumferentially extending series of pairs of ribs 54, 56 pivotally connected to each other by a pin 62 extending through perforations 58 intermediate opposite ends 64, 66 and 68, 70 ribs 54, 56, respectively. The canopy frame 12 can also be readily seen to include a plurality of spokes 48, each of which has a radially inner end extending in one of the holes 15 of hub members 16, 18 and a radially outer end pivotally secured to a separate pair of ribs 54, 56 at the respective intermediate perforations thereof.

Each of the hub members 16, 18 is in the form of a semicircular disc comprising an arcuate portion 20, a diametral edge 22 and a pair of parallel sides 24, 26 with one of the sides 26 of one of the hub members 16 extending in side-by-side relationship to one of the sides 26 of the other of hub members 18 in the closed condition of the canopy frame member 12 and the staff member 14, while in the opened condition of the frame member 12 and the staff member 14 the diametral edges 22 of hub members 26, 18 extending in confronting relationship with each and are separated from each other by the upper link units 32, 40.

The link units 32, 34, 36, 38 and 40, 42, 44, 46 of series 11 and 13 extend approximately end-to-end-with successive link units of the respective series 11 and 13 thereof to extend the staff member 14 in the opened condition of the umbrella construction 10. In the closed condition of the umbrella construction 10 the link units 32, 34, 36, 38 and 40, 42, 44, 46 of series 11 and 13, respectively, are collapsed in stacked relationship on top of or against each other. More specifically, in the closed condition of umbrella frame 10 the link units 32, 34, 36, 38 are collapsed against or on top of each other and the link units 40, 42, 44, 46 are collapsed against or on top of each other as may be seen in FIG. 1. The link units 32, 40 and 38, 46 at opposite ends of staff member 14 are approximately half as long in length as intermediate link units 34, 36 and 42, 44.

Comparing FIGS. 1 and 2, it can be readily appreciated that surface 26 of each of the hub members 16, 18 is rotatable to and from a substantially coplanar relationship with each other as illustrated in FIG. 2 to the confronting relationship with each other as may be seen in FIG. 1. Each spoke 48 is assembled to one of the hub members 16, 18 with a finger-like member 50 bent at about 90° to the main portion of the respective spoke 48 and extending into and being secured in one of the plurality of holes 15 in hub members 16, 18. In the closed condition of canopy member 12 and staff member 14 the pairs of ribs 54, 56 and the spokes 48 pivotally connected thereto extend generally side-by-side in collapsed relationship to each other. The structural connection between each spoke 48 and the ribs 54, 56 connected thereby is achieved by providing a perforation 60 adjacent the radial outer end of the spoke 48, a perforation in each of the ribs 54, 56 intermediate the opposite ends 64, 66 and 68,70 of ribs 54 and 56, respectively, and a pivot pin 62 inserted through perforations 58, 58, 60.

Each of the hub members 16, 18 as disclosed preferably comprises an arcuate portion 20, a diametral edge 22, and two substantially parallel surfaces 24, 26. One of the surfaces 24 as seen in FIG. 1 shows headed ends 52 on the finger-like members 50. These surfaces 24 extend substantially parallel to each other on opposite sides of the frame member 12 in the closed condition thereof as do the surfaces 26 in which are formed the plurality of holes 15 extending inwardly of the respective hub members 16, 18. Hub members 16 and 18 as can be seen in FIG. 1 is secured to upper link units 32 and 40, respectively, adjacent the upper ends thereof. In the opened condition of the umbrella construction 10 the surfaces 26 can be seen to lie in a plane substantially at right angle to the staff member 14.

To open umbrella construction 10 from the condition illustrated in FIG. 1 it is only necessary to pull down on link units 46 away from upper link units 32, 40 on the link units 46 extending beneath the center portion of link unit 44, for example, so that the various link units 32, 34, 36, 38 and 40, 42, 44, 46 wil pivot about the various bores 45 and extend to the extended condition illustrated in FIG. 2. To fold the staff member 14 from the condition of FIG. 2 to that of FIG. 1, it is only necessary to push upwardly on the lower end of lower link units 38, 46 toward hub members 16, 18 so that the various link units 32, 34, 36, 38 and 40, 42, 44, 46 will pivot about the various bores 45 and collapse to the folded condition of FIG. 1.

As hub members 16, 18 are secured to link units 32 and 40, the former will rotate about the upper bore 45 of upper link units 32 and 40 when the latter are pivoted about that same bore 45. From the foregoing it can be readily appreciated as the link units 32, 34, 36, 38 and 40, 42, 44, 46 are extended from the condition of FIG. 1 the canopy frame member 12 is automatically, simultaneously being opened and as the link units 32, 34, 36, 38 and 40, 42, 44, 46 are collapsed from the condition of FIG. 1 the canopy frame member 12 is automatically, simultaneously being closed.

It will be obvious to those skilled in the art that various changes may be made without departing from the scope of the invention and therefore the invention is not limited to what is shown in the drawings and described in the specification but only as indicated in the appended claims.

What is claimed is:

1. Umbrella construction comprising first and second hub members in combination with canopy frame means and staff means, said hub members being spaced-apart from each other on opposite sides of said staff means independent of each other, and provided with a plurality of holes, said staff means including two series of links forming a lazy-tong device adapted to fold together into closed condition and to unfold into opened condition, said two series of links each having an upper link unit pivotally connected to the upper link unit of the other at the upper ends thereof when the staff means is in opened condition, one of said hub members being secured to the upper link unit of one of said series of links adjacent the upper end thereof, the other of said hub members being secured to the upper link unit of the other of said series of links adjacent the upper end thereof and on a side of said staff means opposite from said one of said hub members, said canopy frame means including a circumferentially extending series of pairs of ribs, each rib of said pairs being pivotally connected to the other at a point intermediate the opposite ends thereof, a plurality of spokes each having a radially inner end extending in a separate one of said holes of said hub members and a radially outer end pivotally secured to a separate pair of said ribs at said intermediate point thereof.

2. Umbrella construction as defined in claim 1 wherein each of said hub members is in the form of a semicircular disc comprising an arcuate portion, a diametral edge and a pair of generally parallel sides with one of said sides of one of said hub members extending in side-by-side relationship to one of the sides of the other of said hub members in the closed condition of said frame means and said staff means, and with said diametral edges of said hub members extending in confronting relationship to each and are separated from each other by said upper link units in the opened condition of said frame means and said staff means.

3. Umbrella construction as defined in either of claims 1 or 2 wherein the link units of said two series of links extend approximately end-to-end with successive link units of the respective series thereof to extend said staff means in the opened condition of said umbrella construction.

4. Umbrella construction as defined in claim 3 wherein each diametral edge of said hub members provides a first surface extending along opposite sides of said frame means in the closed condition thereof and at least a second surface on one of said parallel sides from which some of said plurality of holes extend inwardly of the respective hub member, each of said hub members being secured to the respective upper link unit with said first surface being in contact thereagainst.

5. Umbrella construction as defined in claim 4 wherein each of said second surfaces of said hub members lie in a plane substantially at right angle to said staff means in the opened condition of said umbrella construction.

6. Umbrella construction as defined in claim 5 wherein the link units of said two series are collapsed in stacked relationship on top of or against each other in the closed condition of said umbrella construction.

7. Umbrella construction as defined in claim 6 wherein link units of said staff means at opposite ends thereof are approximately half as long in length as intermediate link units thereof.

8. Umbrella construction as defined in claim 7 wherein said second surface of each of said hub members is rotatable to and from a substantially coplanar relationship with the second surface of the other of said hub members to a confronting relationship therewith.

9. Umbrella construction as defined in claim 8 wherein each of said spokes is formed with a finger-like member bent at about 90° to the main portion thereof with each of said finger-like members extending into and being secured in one of said plurality of holes in said hub members.

10. Umbrella construction as defined in claim 9 wherein said pairs of ribs and the spokes pivotally connected thereto extend generally side-by-side in collapsed relationship to each other when said canopy frame means and said staff means are in closed condition.

11. Umbrella construction as defined in claim 10 wherein each of said spokes includes a perforation adjacent the radial outer end thereof with a pivot pin extending through said perforation and pivotally connecting such spoke to a pair of said ribs.

12. Umbrella construction as defined in claim 11 wherein both ribs of each of said pairs of ribs in addition to being pivotally connected to each other are also pivotally connected to one end thereof to one rib of a pair of ribs ahead of it in said series and pivotally connected at the other thereof to one rib of a pair of ribs behind it in said series.

* * * * *